US008262592B1

(12) United States Patent
Brooks et al.

(10) Patent No.: US 8,262,592 B1
(45) Date of Patent: Sep. 11, 2012

(54) FLUID DISPENSER

(76) Inventors: Ray G. Brooks, Bedford, TX (US); Timothy Wayne Brooks, Arlington, TX (US)

( * ) Notice: Subject to any disclaimer, the term of this patent is extended or adjusted under 35 U.S.C. 154(b) by 950 days.

(21) Appl. No.: 12/326,308

(22) Filed: Dec. 2, 2008

Related U.S. Application Data

(60) Provisional application No. 61/016,877, filed on Dec. 27, 2007.

(51) Int. Cl.
*A61H 1/00* (2006.01)
*A61H 1/02* (2006.01)
*A61H 5/00* (2006.01)

(52) U.S. Cl. ..... 601/17; 601/46

(58) Field of Classification Search ..... 601/15, 601/17, 19, 46; 401/214, 216, 219
See application file for complete search history.

(56) References Cited

U.S. PATENT DOCUMENTS 2,968,826 A * 1/1961 Leshin ..... 401/214
3,905,517 A 9/1975 Friedrich et al.
4,025,809 A 5/1977 Teranishi
4,116,571 A 9/1978 Maxwell
4,407,435 A 10/1983 Harmon
4,474,307 A 10/1984 Chappell
4,679,714 A 7/1987 Blake
4,684,046 A 8/1987 Foster et al.
4,757,806 A 7/1988 Muchisky et al.
4,840,798 A 6/1989 Skaliotis
4,852,772 A 8/1989 Ennis, III
D307,115 S 4/1990 Waymack
5,105,802 A 4/1992 Pokorny
5,190,191 A 3/1993 Reyman
5,336,159 A 8/1994 Cheng
5,361,944 A 11/1994 Hauf et al.
5,554,102 A 9/1996 Chiou
5,699,934 A 12/1997 Kolcun et al.
5,788,124 A 8/1998 Bougamont et al.
5,803,313 A 9/1998 Flatt et al.
5,810,495 A * 9/1998 McAuley ..... 401/214
5,894,961 A 4/1999 Kaufman et al.
5,935,089 A 8/1999 Shimizu
6,089,412 A 7/2000 Snell et al.
6,126,620 A 10/2000 Graston
6,179,505 B1 * 1/2001 Oder et al. ..... 401/213
6,244,468 B1 6/2001 Farmer et al.
6,244,475 B1 6/2001 Walz et al.
6,382,472 B1 5/2002 Shoval
6,511,445 B2 1/2003 Sivan et al.
6,536,970 B2 3/2003 Hauser et al.
6,729,788 B2 5/2004 Bouveresse
6,880,735 B2 4/2005 Whitney
6,911,010 B2 6/2005 Dirks et al.

(Continued)

*Primary Examiner* — Kristen Matter
(74) *Attorney, Agent, or Firm* — Geoffrey A. Mantooth

(57) ABSTRACT

An inexpensive and disposable dispenser has few parts. The dispenser has a housing with a reservoir of fluid therein. The housing has a valve seat and a valve. The valve is biased in a closed position by resilient spring arms. Each spring arm has a fixed end coupled to the housing and a free end that contacts a rounded or inclined surface of the valve in a location that is offset from a centerline of movement. As the valve moves to an open position, the spring arms flex with the free ends moving apart. When the spring arms straighten and the free ends move closer to each other, the valve is moved to the closed position. The dispenser can be manipulated by a hand or by a massager. A massager imparts vibrations to the valve by way of the housing and the spring arm. The dispenser can be used to work the fluid into an object such as human skin.

9 Claims, 6 Drawing Sheets

U.S. PATENT DOCUMENTS

| | | | | |
|---|---|---|---|---|
| 6,997,355 | B2 | 2/2006 | Duquet et al. | |
| 7,040,598 | B2 | 5/2006 | Raybuck | |
| 7,169,120 | B2 | 1/2007 | Murdock et al. | |
| 7,188,752 | B2 | 3/2007 | Lecoutre | |
| 7,198,175 | B2 | 4/2007 | Ophardt | |
| 7,211,057 | B2 | 5/2007 | Gleason et al. | |
| 7,296,712 | B2 | 11/2007 | Stradella | |
| 7,311,462 | B2 * | 12/2007 | Kervoalen | 401/216 |
| 7,699,795 | B2 * | 4/2010 | Nan | 601/17 |
| 2003/0171702 | A1 * | 9/2003 | Thompson et al. | 601/72 |

* cited by examiner

FLUID DISPENSER

This application claims the benefit of U.S. provisional patent application Ser. No. 61/016,877 filed Dec. 27, 2007.

FIELD OF THE INVENTION

The present invention relates to apparatuses for dispensing fluids.

BACKGROUND OF THE INVENTION

There are a number of dispensers on the market that dispense viscous fluids, such as lotions, gels and colloid products, onto areas of human bodies. These dispensers utilize pressure over an area to dispense fluid. One such type of dispenser utilizes a spring acting on a piston in a cylinder to dispense fluid. Another type utilizes hand pressure applied to a piston in a cylinder. Still another type utilizes an electric pump.

These prior art dispensers have too many parts to be made inexpensively and are difficult to grip for hand manipulation and use.

It is desirable to provide a dispenser that is simple in design and inexpensive to manufacture.

SUMMARY OF THE INVENTION

The present invention provides a fluid dispenser that comprises a housing having a reservoir for the fluid. The housing has an opening. A valve seat is located at the housing opening. A valve is located in the housing and is movable from a closed position against the valve seat to an open position away from the valve seat. The valve has an inclined surface. At least two spring arms are located in the housing. Each spring arm has a fixed end coupled to the housing and a free end. Each spring arm has a longitudinal axis between the fixed and free ends. Each spring arm is flexible along the longitudinal axis. The free ends contact the valve on the valve inclined surface. The spring arms bias the valve in the closed position. When the valve is in the open position, the spring arms are flexed.

In accordance with one aspect of the present invention, the free ends of the spring arms move apart when the valve is moved to the open position.

In accordance with another aspect of the present invention, the spring arms comprise three spring arms arranged in a tripod configuration.

In accordance with still another aspect of the present invention, the valve is a ball.

In accordance with still another aspect of the present invention, the longitudinal axes of the spring arms are offset from a centerline of the valve seat.

In accordance with still another aspect of the present invention, the longitudinal axes of the spring arms are substantially parallel to the valve seat centerline.

In accordance with still another aspect of the present invention, the spring arms comprise three spring arms arranged in a tripod configuration. The longitudinal axes of the spring arms are offset from a centerline of the valve seat. The longitudinal axes of the spring arms are substantially parallel to the valve seat centerline. The valve is a ball.

In accordance with still another aspect of the present invention, the housing is a coupler that is structured and arranged to couple to a vibrator.

In accordance with still another aspect of the present invention, the fixed ends of the spring arms are coupled to the coupler so as to receive vibrations therefrom.

The present invention also provides a method of dispensing fluid. A reservoir of fluid is provided. A valve and a valve seat are provided on the reservoir. The valve is movable along an axis between open and closed positions relative to the valve seat. The valve is biased in a closed position by contacting the valve with resilient elongated members. Each member applies a force to the valve in a direction that is toward the valve seat and toward the axis.

In accordance with one aspect of the present invention, vibrations are imparted to the valve by way of the members.

In accordance with still another aspect of the present invention, the step of imparting vibrations to the valve occurs when the valve is opened.

In accordance with still another aspect of the present invention, the step of imparting vibrations to the valve occurs when the valve is closed.

BRIEF DESCRIPTION OF THE DRAWINGS

FIG. 4 shows the dispenser in the closed valve position. FIG. 5 shows the dispenser in the open valve position.

DESCRIPTION OF THE PREFERRED EMBODIMENT

Figure 4:
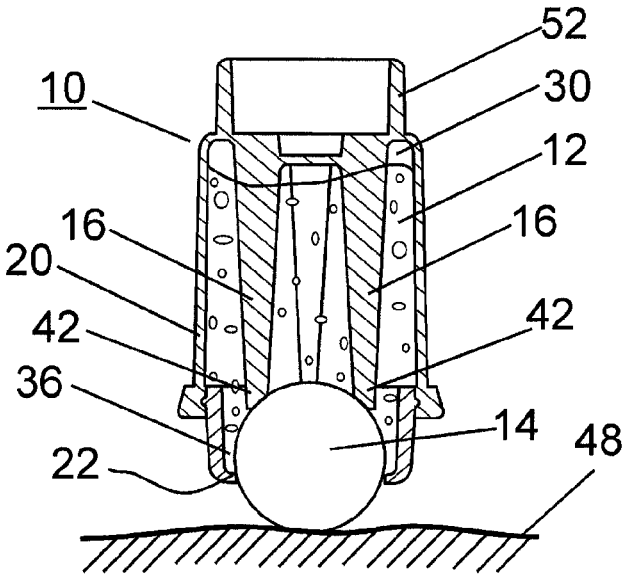
FIGS. 4 and 5 are cross-sectional views illustrating the operation of the dispenser.

The dispenser 10 of the present invention is an inexpensive device that, in one embodiment, can be disposed of after use. As shown in FIG. 4, the dispenser 10 has a quantity of fluid or liquid 12, which is to be dispensed. The fluid 12 is prevented from exiting the dispenser by a valve 14. The valve 14 is biased in the normally closed position by resilient spring arms 16. To dispense a quantity of the liquid 12, the valve 14 is pressed in (see FIG. 5), wherein the valve 14 is opened. The spring arms 16 flex and spread apart to allow the valve 14 to move into an open position. The fluid 12 can then exit the dispenser 10. When the inward force on the valve 14 is removed, the spring arms 16 force the valve back to the closed portion (see FIG. 4), wherein no more fluid is dispensed.

The dispenser dispenses fluids or liquids. The fluid can be a liquid, cream, lotion or gel and can be hygienic, medical and/or therapeutic suitable for application to areas of the human body. Preferably, the fluid is more viscous than water.

The dispenser 10 will now be described in more detail. The dispenser 10 has a housing 20, a valve 14, a valve seat 22 and a cap 24.

Figure 1:
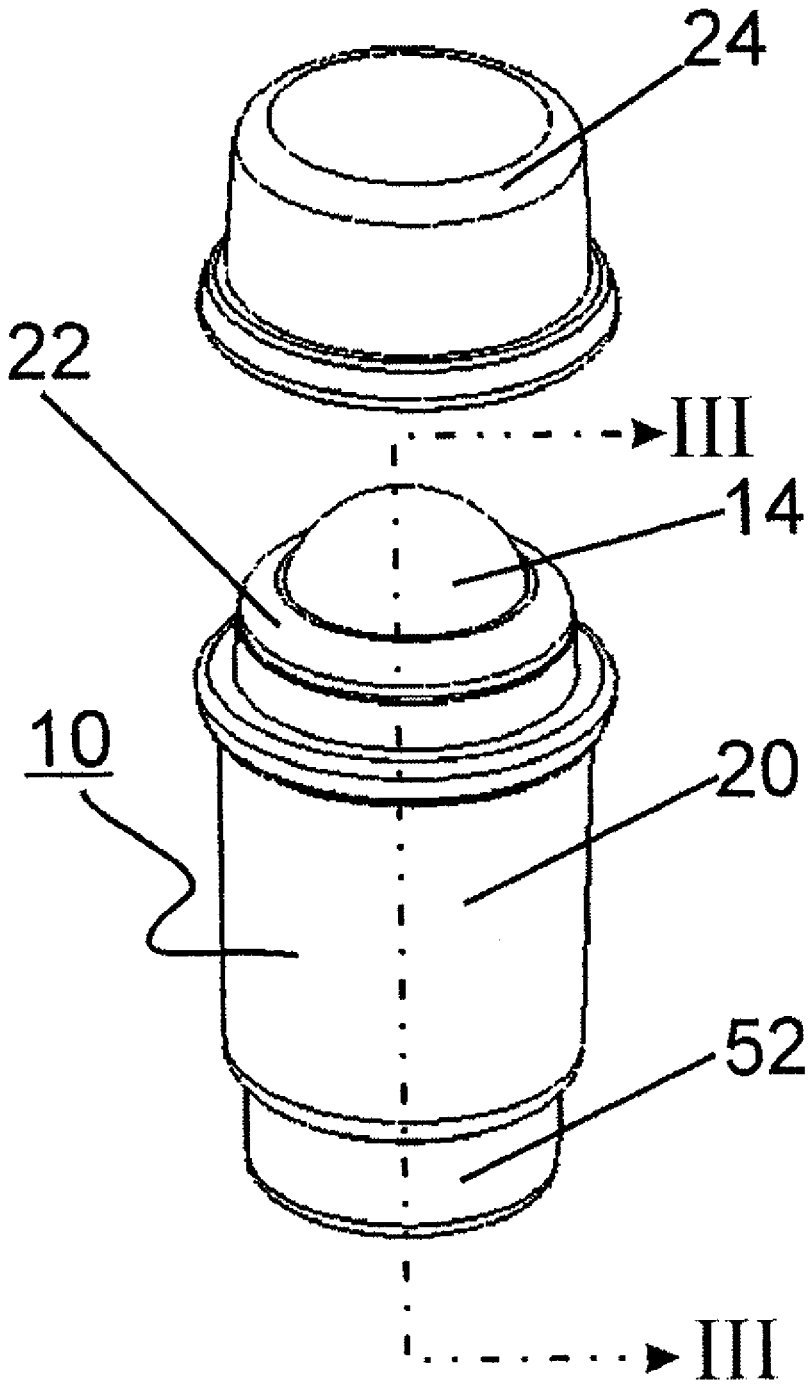
FIG. 1 is a perspective view of the dispenser of the present invention, in accordance with a preferred embodiment, shown with the cap removed.
Figure 2:
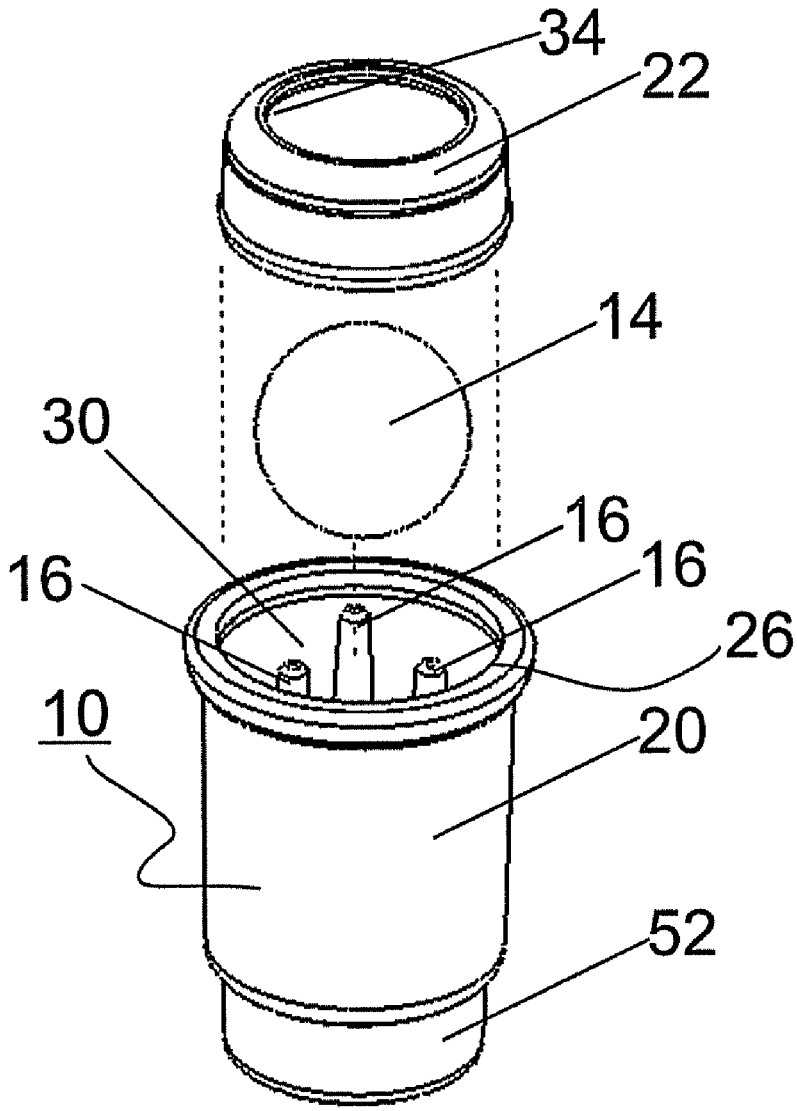
FIG. 2 is an exploded perspective view of the dispenser without the cap.
Figure 3:
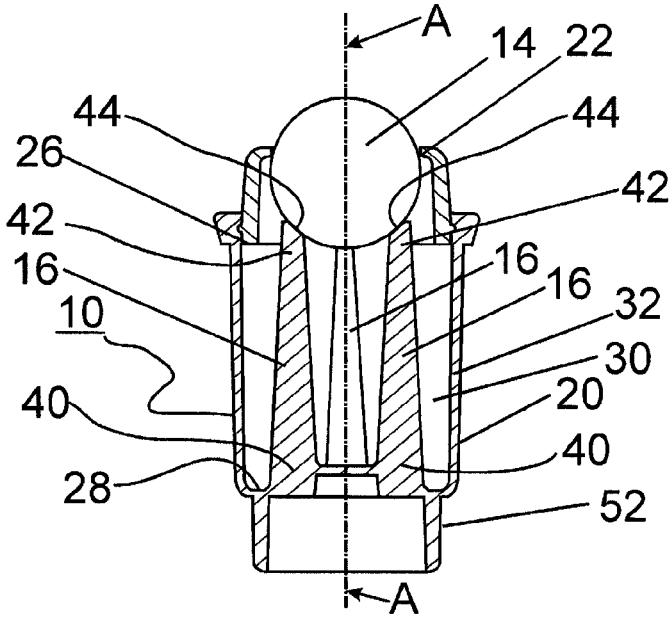
FIG. 3 is a longitudinal cross-sectional view of the dispenser, taken along lines of FIG. 1.

Referring to FIGS. 1-3, the housing 20 has an open end 26, a closed end 28 and a reservoir 30 inside. In the embodiment shown, the closed end 28 is closed and has no openings. A side wall 32 extends between the open and closed ends 26, 28. In the preferred embodiment, the side wall 32 is cylindrical. The open end 26 receives the valve 14 and the valve seat 22.

The valve seat 22 is ring shaped, having an opening 34 therethrough. The valve seat 22 couples to the open end 26 of the housing. In the embodiment shown, the valve seat 22 has a circumferential rib that is received in a circumferential groove in the housing. The valve seat can be coupled to the housing in other ways as well, such as by a threaded coupling.

The valve 14 is biased in the closed position by way of the spring arms 16, or resilient members. Each spring arm 16 has a fixed end 40 coupled to the housing at or near the housing closed end 28. In addition, each spring arm has a free end 42 that contacts the valve 14. In the embodiment shown, there are three spring arms 16 arranged in a tripod configuration. The arrangement of spring arms 16 is centered along a centerline A of the opening 34 in the valve seat. The valve 14 moves generally along this centerline A between open and closed positions. The valve 14 may not be on the centerline A due to differences in resiliency of the individual spring arms 16 or because of inconsistencies in the fluid. Each spring arm has a longitudinal axis that extends between the respective fixed and free ends 40, 42. The spring arms 16 are resilient along their respective longitudinal axes. As a spring arm is flexed by moving the free end 42, it will straighten when the free end is released. The longitudinal axes of the spring arms are generally parallel to the centerline A.

The free ends of the spring arms are spaced apart from each other and are offset from the centerline A of the valve 14. The free ends 42 of the spring arms 16 contact the valve 14 at rounded or at inclined surfaces 44 on the valve. In the preferred embodiment, the valve 14 is a ball. In the normally closed position, shown in FIGS. 3 and 4, the valve 14 spreads the free ends 42 of the spring arms 16 apart slightly; this provides a sufficient bias or force on the valve 14 against the seat 22 to insure closure.

In the preferred embodiment, the spring arms 16 are integral to the housing 20. The housing 20 can be molded in one piece. For example, the housing can be injection molded. The individual spring arms 16 are tapered, with the fixed end 40 being larger or wider than the free end 47.

Figure 5:
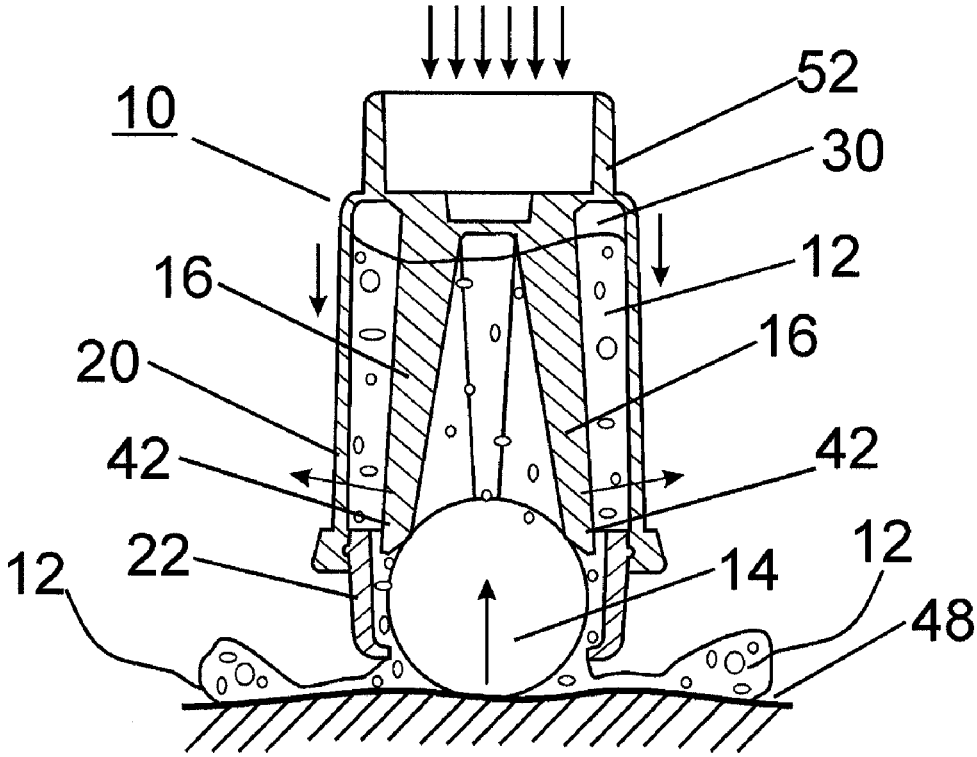

The valve 14 can be pushed into the housing 20, as shown in FIG. 5, wherein the valve opens. In the open position, the valve 14 forces the free ends 42 of the spring arms 16 apart, flexing the spring arms outwardly. When the valve is released, the spring arms 16 attempt to straighten, and push the valve 14 against the valve seat 22, thereby closing the valve. The spring arms 16 each apply a force to the valve in a direction that is both towards the valve seat 22 and toward the centerline A.

The cap 24 covers the valve 14 and prevents dispensing of the liquid. The cap removably couples to the housing. For example, the housing has a lip at its open end, wherein the cap 24 snap fits onto the housing lip.

Liquid is loaded into the housing by removing the valve seat 22 and valve 14. This exposes the open end 26 of the housing 20, through which liquid can be provided. When the housing is filled with a sufficient quantity of liquid, the valve 14 and valve seat 22 are replaced and the dispenser is ready to use.

The use of the dispenser 10 will now be discussed. The dispenser housing 20 is sized and shaped to be gripped by a hand. Referring to FIG. 4, as previously discussed, the valve 14 is normally closed. The spring arms 16 bias or force the valve 14 against the seat 22. In order to dispense some of the liquid, the user grips the dispenser in a hand and turns the dispenser so that the valve is at the bottom. This allows gravity to pull the liquid 12 down toward the valve seat 22. Some liquid is located in the gap 36 between the valve and the valve seat (see FIG. 4).

As shown in FIG. 5, the dispenser is pushed against the object 48, such as a human body. The valve 14 is pushed into the housing, creating an opening at the valve seat 22 for some of the liquid to exit the housing. The size of opening 22 and the quantity of fluid dispensed depends on the pressure exerted on the valve 14. If the dispenser 10 is lightly pressed against the object 48, the opening 22 will be relatively small. If the dispenser is pressed harder against the object, the opening 22 will be larger and more fluid will be dispensed. As the valve 14 is forced into the housing 20, the free ends 42 of the spring arms 16 move apart from each other. The fixed ends 40 remain fixed. To stop dispensing liquid, the force applied to the closed end of the dispenser is removed. The free ends 42 of the spring arms move closer together and return the valve 14 to the valve seat to close the valve (see FIG. 4).

In order to dispense liquid, the ball valve 14 need not be rolled on the object. Instead, the dispenser can merely be pushed against the object in a stationary position. The amount of liquid dispensed depends on the viscosity and the surface tension of the liquid, on the size of the opening and the duration of time the valve is opened.

The ball valve 14 may be moved or rolled across the object to assist in dispensing liquid and also to assist in spreading the liquid on the object. As the ball valve rotates, a quantity of liquid in the reservoir adheres to the ball valve and moves into contact with the object, wherein the liquid is transferred to the object. Very little force or pressure need to be applied to the dispenser in order to dispense liquid in this manner. A more precise metering of the amount of liquid applied to the object can be obtained in this manner.

Rolling the dispenser valve 14 on objects 48 such as skin, assists in working the fluid into pores.

Figure 6:
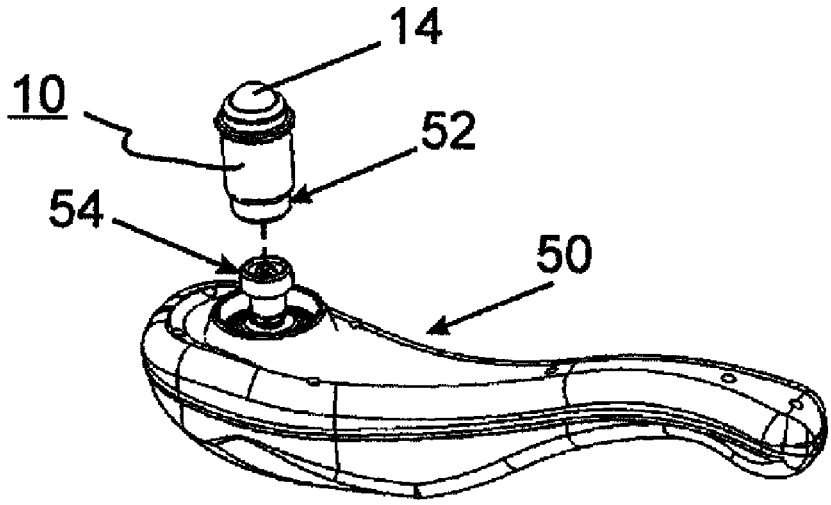
FIG. 6 shows the attachment of the dispenser to one type of a massager device.
Figure 7:
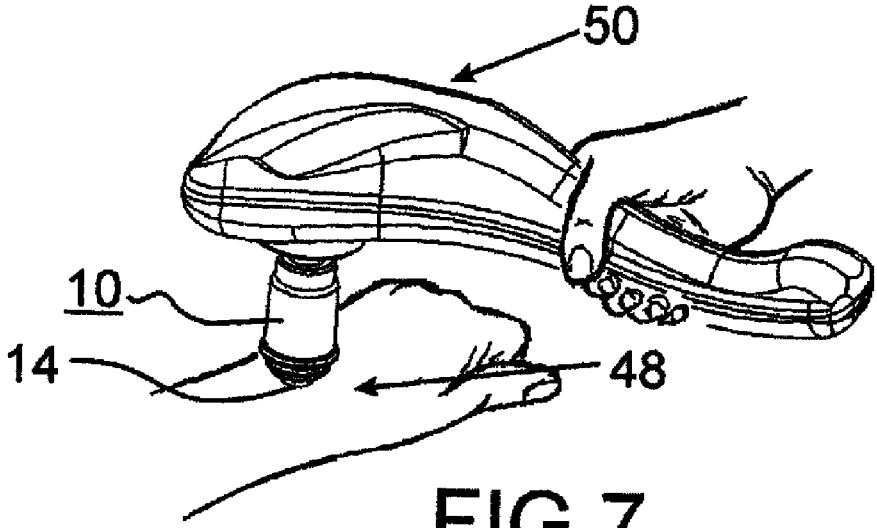
FIG. 7 shows the use of the dispenser and the massager device.

The dispenser 10 can be manipulated by hand. Alternatively, the dispenser can be manipulated in conjunction with mechanical or electrical devices, such as a massager 50, which is shown in FIGS. 6 and 7. The massager 50, which is conventional and commercially available, is electrically driven (such as by a battery). In order to adapt the dispenser to be used in conjunction with such a device as the massager 50, the closed end of the housing is provided with a female coupler 52. The massager 50 has a corresponding male coupler 54. The massager 50 imparts vibrations to the male coupler 54. The dispenser 10 is coupled to the massager 50 by way of the couplings 52, 54 which create an interference fit. There are other ways to couple the dispenser to the massager such as a threaded coupling 52A, 54A (see FIG. 11).

Figure 11:
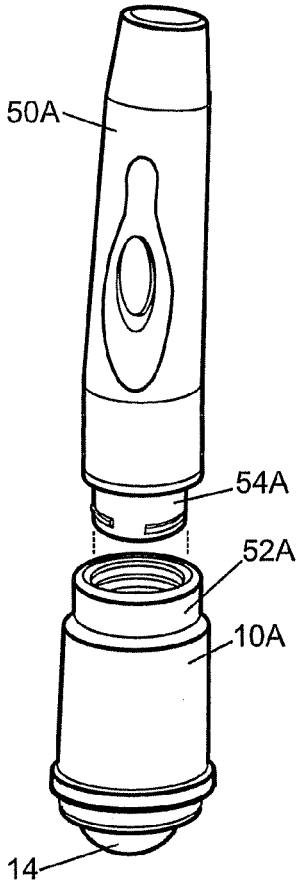
FIG. 11 shows the dispenser and another type of massager device.

FIG. 11 shows another type of massager 50A. While the massager 50 of FIGS. 6 and 7 has a handle oriented at an angle (such as a right angle) to the dispenser 10, the massager 50A is oriented in line with the dispenser 10A. The massager 50A imparts vibrations to the male coupler 54A, which in turn transfers vibrations to the female coupler 52A and the other components of the dispenser 10A.

Once the dispenser is mounted to the massager, the dispenser is turned upside down so that the valve 14 is against the object 48. The massager 50, 50A is turned on, wherein a vibrating action is produced by the massager 50, 50A and imparted to the valve 14 and the object 48. Liquid can be dispensed by applying force on the dispenser to open the valve 14. The vibrations from the massager 50, 50A are transferred to the valve 14 not only by the housing 20 but also by the spring arms 16. The fixed ends 40 of the spring arms are directly coupled and close to the coupler 52. Thus, the quality of the vibrations as applied to the valve and the object are enhanced. The valve 14 can be moved across the object as it is vibrated to work in the fluid.

Using the dispenser in conjunction with a massager assists in working the fluid to be worked into the object. For example, if lotion is being applied to a sore knee, the dispenser and massager not only apply the lotion to the knee area but also work it in to the human skin.

The dispenser 10 can be injection molded in an inexpensive manner. Thus, the dispenser is designed to be disposable after the liquid has been exhausted in the reservoir. If the dispenser is being used on a massager, and runs empty of fluid, it is simply replaced with another dispenser having fluid therein.

Figure 10:
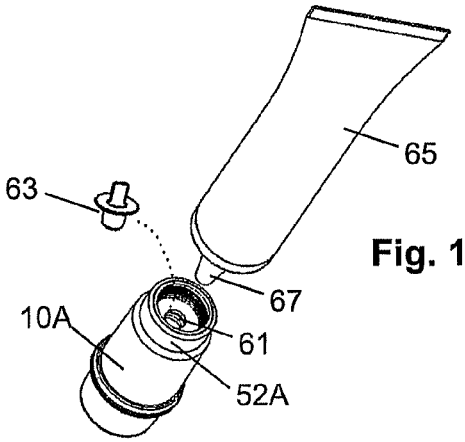
FIG. 10 is a perspective view showing the dispenser and refill container of FIG. 8.
Figure 8:
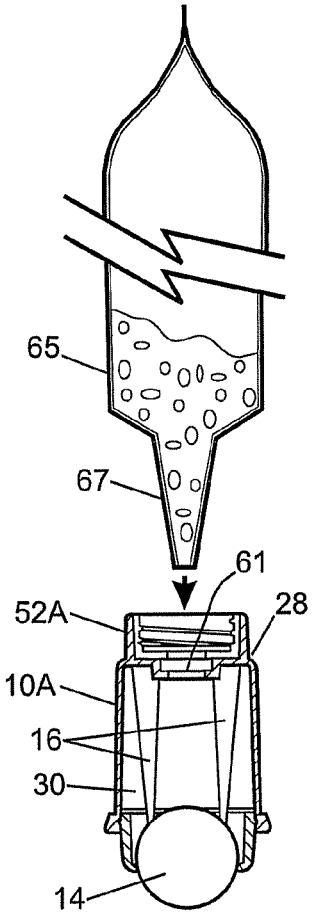
FIG. 8 shows the dispenser in accordance with another embodiment, with a refill container.
Figure 9:
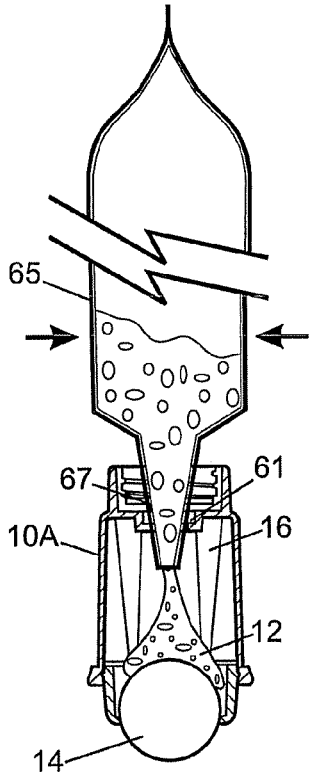
FIG. 9 shows the dispenser and refill container of FIG. 8, in a refilling operation.

Alternatively, the dispenser 10A can be refilled, as shown in FIGS. 8-10. The dispenser 10A is substantially the same as the dispenser 10 shown in FIGS. 3-5. The end 28 of the housing has an opening 61, or port, therein. A cap 63 is provided to plug the opening 61. To refill the dispenser with fluid 12, the cap 63 is removed. The fluid can be provided in a refill container 65, which has a nozzle 67. The nozzle 67 is inserted into the opening 61 and fluid is dispensed. If the container 65 has squeezable sides, pressure is applied as shown in FIG. 9, to force the fluid into the dispenser. After refilling, the nozzle 67 is removed and the cap 63 is replaced in the opening 61. As an alternative, fluid can be poured or dripped directly into the opening 61.

Although the dispenser is shown and described as having a female coupling for a massager, it may have a larger reservoir in the form of an extension tube coupled to the housing opposite the open end 26. The extension tube can be replaceable so as to allow the dispenser to be refitted with fluid.

Although the dispenser has been described as utilizing gravity feed to direct the liquid to the valve seat, other mechanisms can be used. For example, a pressurized reservoir could be used to force the liquid toward the valve seat. One way to accomplish a pressurized reservoir is by a spring loaded piston in the reservoir, which piston forces fluid or liquid toward the valve seat.

Although the dispenser has been described with three spring arms, as few as two spring arms can be used. The free ends of the spring arms would be arc shaped so as to provide some lateral stability to the valve as the valve moves away from the valve seat to an open position. This ensures that the valve stays centered between the spring arms and will return to a closed position. Alternatively, more than three spring arms can be used.

Although the valve has been described as a ball, the valve can take other shapes. The surfaces of the interior of the valve that contact the spring arms are inclined or rounded as discussed above. The valve need not rotate or spin, but can simply move to open and close. For example, the valve can be a hollow hemisphere, with the convex portion facing out. The inside, or convex portion, has inclined ramps for contacting the free ends of the spring arms.

The foregoing disclosure and showings made in the drawings are merely illustrative of the principles of this invention and are not to be interpreted in a limiting sense.

The invention claimed is:

1. A fluid dispenser, comprising:

a) a housing having a reservoir for the fluid, the housing having an opening;

b) a valve seat located at the housing opening;

c) a valve located in the housing and movable from a closed position against the valve seat to an open position away from the valve seat, the valve having an inclined surface;

d) at least two spring arms located in the housing, each spring arm having a fixed end coupled to the housing, and a free end, each spring arm having a longitudinal axis between the fixed and free ends, each spring arm being flexible along the longitudinal axis, the free ends contacting the valve on the valve inclined surface, the spring arms biasing the valve in the closed position, wherein when the valve is in the open position, the spring arms are flexed;

e) a vibrator coupled to the housing, wherein the vibrator produces vibrations in the valve by way of the spring arms; and wherein the housing has a first end and a second end, the valve seat is located at the housing first end, the vibrator is coupled to the housing second end, and the fixed ends of the respective spring arms are located at the housing second end.

2. The dispenser of claim 1, wherein the free ends of the spring arms move apart when the valve is moved to the open position.

3. The dispenser of claim 1, wherein the spring arms comprise three spring arms arranged in a tripod configuration.

4. The dispenser of claim 1, wherein the valve is a ball.

5. The dispenser of claim 1, wherein the longitudinal axes of the spring arms are offset from a centerline of the valve seat.

6. The dispenser of claim 5, wherein the longitudinal axes of the spring arms are substantially parallel to the valve seat centerline.

7. The dispenser of claim 1, wherein:

a) the spring arms comprise three spring arms arranged in a tripod configuration;

b) the longitudinal axes of the spring arms are offset from a centerline of the valve seat;

c) the longitudinal axes of the spring arms are substantially parallel to the valve seat centerline;

d) the valve is a ball.

8. The dispenser of claim 1, wherein the housing has a coupler that removably couples to the vibrator.

9. The dispenser of claim 8, wherein the fixed ends of the spring arms are coupled to the coupler so as to receive vibrations therefrom.

* * * * *